US011208618B2

(12) United States Patent
Norman et al.

(10) Patent No.: US 11,208,618 B2
(45) **Date of Patent: *Dec. 28, 2021**

(54) LAVATORY CLEANSING BLOCK

(71) Applicant: Henkel Limited, Hertfordshire (GB)

(72) Inventors: Russell Norman, Thetford (GB); Brian Wilson, Glasgow (GB); Clare Lidbetter, Cambridgeshire (GB); Janice Kavaney, Kings Lynn (GB)

(73) Assignee: Henkel Limited, Hertfordshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/872,286

(22) Filed: Jan. 16, 2018

(65) Prior Publication Data

US 2019/0218482 A1 Jul. 18, 2019

Related U.S. Application Data

(63) Continuation of application No. PCT/GB2016/052127, filed on Jul. 14, 2016.

(30) Foreign Application Priority Data

Jul. 16, 2015 (GB) ..... 1512449

(51) Int. Cl.

| | |
|---|---|
| ***C11D 1/24*** | (2006.01) |
| ***C11D 1/72*** | (2006.01) |
| ***C11D 3/22*** | (2006.01) |
| ***C11D 3/37*** | (2006.01) |
| ***C11D 3/40*** | (2006.01) |
| ***C11D 17/00*** | (2006.01) |
| ***C11D 3/18*** | (2006.01) |

(Continued)

(52) U.S. Cl.

CPC ..... *C11D 17/0056* (2013.01); *C11D 1/143* (2013.01); *C11D 1/22* (2013.01); *C11D 1/37* (2013.01); *C11D 1/83* (2013.01); *C11D 3/188* (2013.01); *C11D 3/202* (2013.01); *C11D 3/2013* (2013.01); *C11D 3/2037* (2013.01); *C11D 3/2062* (2013.01); *C11D 3/225* (2013.01); *C11D 3/40* (2013.01); *C11D 3/50* (2013.01)

(58) Field of Classification Search

CPC .. C11D 1/143; C11D 1/24; C11D 1/72; C11D 3/188; C11D 3/22; C11D 3/225; C11D 3/37; C11D 3/40; C11D 17/0056

See application file for complete search history.

(56) References Cited

U.S. PATENT DOCUMENTS 4,861,511 A * 8/1989 Kaplan ..... C11D 3/3769 510/193

2002/0035049 A1 3/2002 Suri et al.

FOREIGN PATENT DOCUMENTS

GB 2021143 A 11/1979
GB 2322632 A 9/1998

(Continued)

OTHER PUBLICATIONS

PCT International Search Report PCT/GB2016/052127 completed: Nov. 14, 2016; dated Jan. 18, 2017 5 pages.

*Primary Examiner* — Brian P Mruk
(74) *Attorney, Agent, or Firm* — Bojuan Deng

(57) ABSTRACT

A lavatory cleansing block including: an alkane sulfonate; a carboxymethylcellulose; a dye; and a hydrophobe; wherein the weight ratio of carboxymethylcellulose to dye in the block is 1.5:1 to 0.8:2 and wherein the block is substantially free of guar gum.

28 Claims, 3 Drawing Sheets

(51) Int. Cl.

| | |
|---|---|
| ***C11D 3/20*** | (2006.01) |
| ***C11D 1/14*** | (2006.01) |
| ***C11D 1/83*** | (2006.01) |
| ***C11D 1/37*** | (2006.01) |
| ***C11D 1/22*** | (2006.01) |
| ***C11D 3/50*** | (2006.01) |

(56) References Cited

FOREIGN PATENT DOCUMENTS

WO WO 98/37171 * 8/1998 ..... C11D 17/00
WO 0078911 A1 12/2000

* cited by examiner

| Minutes \ Hours | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| 0 | | | | | | | | | | | | | | | X | | | | | | | | | X |
| 5 | | | | | | | | | | | | | | | | | | | | | | | | |
| 10 | X | | | | | | | | | | X | | | | | | | | | | | | | |
| 15 | | | | | | | | | | | | | | | | | | | | | | | | X |
| 20 | | | | | | | | | | | X | | | | | | | X | X | | | | X | |
| 25 | | | | | | | | | | | | | | | | | | | | | | | | |
| 30 | | | | | | | | | | | | X | | | | | | | | | | | | |
| 35 | | | | | | | | | | | | | | | | | | | | | | | | |
| 40 | | | | | | | | | | | X | | | | | | | X | | | | | | |
| 45 | | | | | | | | | | | | | | | | | | | | | | | | |
| 50 | | | | | | | | | | | | | | | | | | | | | | | | |
| 55 | | | | | | | | | | | | | | | | | | | | | | | | |
Figure 1
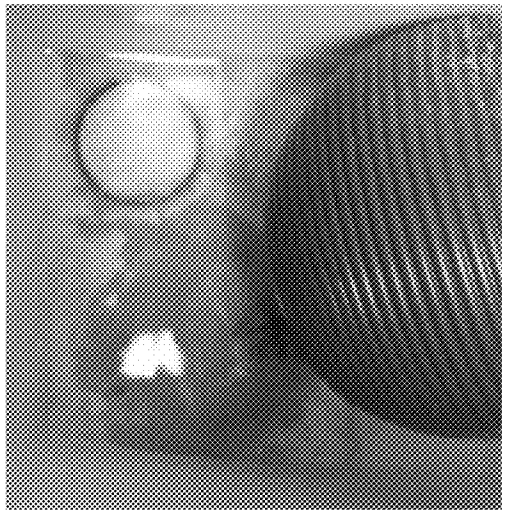
Figure 2a
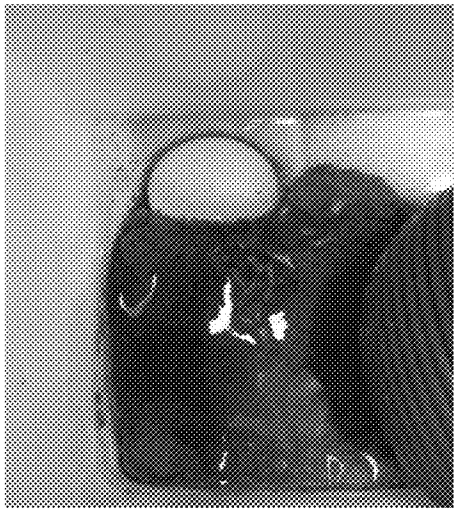
Figure 2b

LAVATORY CLEANSING BLOCK

FIELD OF THE INVENTION

The present invention relates to a lavatory cleansing block, to a packaged product comprising the lavatory cleansing block and to method for preparing the cleansing block. The invention also relates to a composition for preparing the blocks and to use of the composition to prepare the blocks. Additionally, the invention relates to a method of cleansing a lavatory appliance using the blocks of the invention.

BACKGROUND OF THE INVENTION

Lavatory cleansing blocks are generally used in either one of two modes, either as an "ITC" or "in the cistern" mode, or as an "ITB" or "in the bowl" mode. When used in the cistern, the block is placed in the cistern or toilet tank wherein it dissolves over a period of time and thus delivers active agents to the water present in the cistern which is periodically used to flush the toilet bowl. The block is generally placed in the interior of the cistern as a tablet or other self-supporting shape. When used in the bowl, the block is generally placed within the bowl, usually using a cage or holder, so that the active agents are contacted with water flushed into the lavatory appliance, especially the bowl of a toilet, or the interior of a urinal. In this set up the block is dissolved with each flush of water passing though the appliance such that an amount of active agent is dispensed to the toilet bowl, urinal, etc.

The quantity of ingredients delivered into the toilet bowl during each flush cycle of the toilet will in turn affect the actual and perceived performance of the block. The perceived benefit of a block, usually the result of the observation of color and/or foaming, can be as important as the actual effect of the active ingredients in determining the commercial success of a block. The extent to which a cleansing block provides a cleansing action per se depends on, for example, the active ingredients used, the overall composition of the block, the nature of the block and the quantity dosed into the lavatory during a flush cycle. Similarly the perceived performance of a block depends on the surfactants and/or dyes used, the overall composition and nature of the block and the quantity dosed.

In many instances the preferred toilet life of the block is at least 60 days. The toilet life of the block is governed in particular by the amount of material in the block and the rate at which the block dissolves in the flush water, and this depends primarily on the composition and nature of the block. The toilet life will also depend in part on the hardness of the flush water, the ambient temperature, the frequency of flushing and even the toilet design. These factors are well known in the art and the blocks can be tested against a range of conditions when determining a suitable composition for a particular market.

There is a considerable volume of prior art describing different lavatory cleansing blocks which address various problems such as block instability, uncontrolled release of active agent especially towards the end of toilet life, poor perceived performance, poor handling behavior and manufacturing problems. Many of these problems arise because it is difficult to balance the effective and/or perceived cleansing performance of a block against the desired toilet life, whilst maintaining a viable and economic block size and even block performance over the majority of the lifetime of the block.

Thus there is still a need for further and improved toilet blocks. One problem with existing toilet blocks is that during use they form a crust on their surface which can impede release of their constituents. To date, this problem has been overcome by the inclusion of guar gum in the blocks. For example, U.S. Pat. No. 4,861,511 discloses a composition comprising guar gum which is capable of preventing mineral staining of toilet bowls, whilst simultaneously cleaning the toilet bowls. A further related problem with existing toilet blocks, especially those comprising guar gum, is that they can leave behind a colored residue, for example in the cistern or in the bowl depending on the type of block, and this is perceived as a negative by the user. The color is derived from the dye present in the blocks. This problem is further exacerbated by toilet blocks that are used in hard water conditions.

GB 2322632 and WO 00/78911 each disclose ITC or ITB toilet cleaning blocks. The toilet block composition disclosed in GB 2322632 comprises anionic detergents, non-ionic detergents, sodium carboxymethylcellulose, a solubility regulator, a fragrance and a dye. The toilet block composition disclosed in WO 00/78911 comprises anionic surfactants, non-ionic surfactants, an oxidising agent, a pH adjusting agent, a dyestuff and a solubility control agent which can be a carboxymethylcellulose sodium salt. There is, however, no disclosure in either GB 2322632 or WO 00/78911 of the amount of residue the toilet blocks leave behind at the end of their toilet lives.

BRIEF SUMMARY OF THE INVENTION

Viewed from a first aspect the present invention provides a lavatory cleansing block comprising:

an alkane sulfonate;

a carboxymethylcellulose;

a dye; and a hydrophobe;

wherein the weight ratio of carboxymethylcellulose to dye in said block is 1.5:1 to 0.8:2 and wherein said block is substantially free of guar gum.

Viewed from a further aspect the present invention provides a packaged product comprising a block as hereinbefore described.

Viewed from a further aspect the present invention provides a method for preparing a block as hereinbefore described, comprising:

(i) preparing a mixture of an alkane sulfonate, a carboxymethylcellulose, a dye, and a hydrophobe;

(ii) extruding said mixture into rod or bar form; and (iii) cutting said rod or bar into said blocks.

Viewed from a further aspect the present invention provides a composition comprising:

15 to 35 wt % alkane sulfonate;

2 to 15 wt % carboxymethylcellulose;

0.5 to 10 wt % dye; and 2 to 15 wt % hydrophobe;

wherein the weight ratio of carboxymethylcellulose to dye in said composition is 1.5:1 to 0.8:2 and wherein said composition is substantially free of guar gum.

Viewed from a further aspect the present invention provides the use of a composition comprising an alkane sulfonate, a carboxymethylcellulose, a dye, and a hydrophobe in the preparation of a lavatory cleansing block as hereinbefore described.

Viewed from a further aspect the present invention provides a method of cleansing a lavatory, comprising: placing a lavatory cleansing block as hereinbefore described in the cistern of said lavatory.

Viewed from a further aspect the present invention provides the use of a lavatory cleansing block as hereinbefore described for cleansing a lavatory, wherein said block is placed in the cistern of said lavatory.

Definitions

Block as referred to herein is a solid block which is a solid at 25° C. and atmospheric pressure.

Toilet life as referred to herein is the number of days for which a block is effective when tested in a UK style, 9 liter Magnia Armitage Shanks flush toilet cistern with a domestic flush pattern of 12 flushes per day, at 16 to 19° C. The end of life is preferably determined visually by the absence of foam and/or color.

Hard water as referred to herein is water containing more than 200 mg of calcium carbonate per liter.

Soft water as referred to herein is water having less than 10 mg of calcium carbonate per liter.

Acid Blue 9 as referred to herein is ethyl-[4-[[4-[ethyl-[(3-sulfophenyl)methyl]amino]phenyl]-(2-sulfophenyl) methylidene]-1-cyclohexa-2,5-dienylidene]-[(3-sulfophenyl)methyl]azanium, also known as Brilliant Blue FCF.

BRIEF DESCRIPTION OF THE DRAWINGS

These and other aspects of the invention will now be further described, by way of example only, with reference to the accompanying figures in which:

FIG. 1 is a diagram to describe the automatic flush protocol employed to test the blocks of the present invention;

FIG. 2*a* is a photograph showing the residue remaining in the cistern at the end of the useful life of a CMC-containing block when tested using a supply of hard water;

FIG. 2*b* is a photograph showing the residue remaining in the cistern at the end of the useful life of a guar gum-containing block when tested using a supply of hard water;

DETAILED DESCRIPTION OF THE INVENTION

Figure 3:
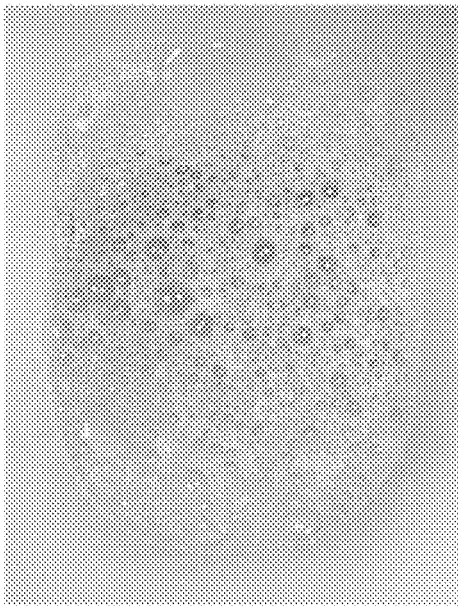
FIG. 3 is a photograph showing the end of life performance in the toilet bowl of a CMC-containing block when tested using a supply of hard water.

The lavatory cleansing block of the present invention comprises:

an alkane sulfonate;

a carboxymethylcellulose;

a dye; and a hydrophobe;

wherein the weight ratio of carboxymethylcellulose to dye in said block is 1.5:1 to 0.8:2 and wherein said block is substantially free of guar gum.

In preferred blocks of the invention, the carboxymethylcellulose is present in an amount of 2 to 15 wt %, more preferably 3 to 10 wt % and still more preferably 3.5 to 9 wt % based on the total weight of the block. In preferred blocks of the invention, the dye is present in an amount of 0.5 to 10%, more preferably 1 to 8.0% and still more preferably 3 to 6% by weight of the total block.

The blocks of the present invention therefore essentially comprise carboxymethylcellulose and a dye. The blocks of the present invention comprise carboxymethylcellulose in place of guar gum. Thus preferred blocks of the present invention comprise no guar gum. Without wishing to be bound by theory, it is believed that the presence of carboxymethylcellulose in the blocks of the invention is advantageous as it is better at releasing the dye additionally present in the block. It is thought that it is the presence of the carboxymethylcellulose which enables a more complete release of dye during use of the blocks of the present invention and which allows for the amount of dye used to be minimized without compromising the perceived cleansing effect of the blocks. It is also thought that compared to guar gum, carboxymethylcellulose has a lesser tendency to form an insoluble matrix that traps components of the block and in particular the dye. These trapped components including dye are what are present in the residue at the end of the toilet life of the block. The carboxymethylcellulose is therefore believed to be responsible for lowering the residue levels present at the end of toilet life.

Preferably the carboxymethylcellulose used in the blocks of the present invention has a viscosity range of 1000 to 8000 cP, more preferably 1500 to 6000 cP and still more preferably 2500-4500 cP when tested as a 1% solution in water at 25° C., 30 rpm and using a rheometer, e.g. with a LV spindle. Preferably the carboxymethylcellulose has a degree of substitution of 0.6 to 1.45, more preferably 0.75 to 0.95 and still more preferably 0.8-0.95. Preferably the carboxymethylcellulose has a pH of 6.0 to 9.0 and more preferably 6.5 to 8.5. Preferably the carboxymethylcellulose has a weight average molecular weight of 150,000 to 2,000,000 g, more preferably 200,000 to 1,800,000 g and still more preferably 220,000 to 1,800,000 g.

The blocks of the present invention additionally comprise a dye. As used herein the term dye refers to any compound that imparts a color when it is contacted with water. When the toilet comprising the block of the present invention is flushed, the dye is released and colors the water in the toilet bowl. This is the primary indicator to users of the blocks that the block is working, i.e. it is the primary indicator of the perceived effect of the block. The coloring effect of the dye is also often used to determine the end of the life of the block. Thus when no color is produced on flushing, the block is assumed to be consumed, i.e. it has reached the end of its toilet life. The primary function of the dye is not therefore to improve the appearance of the blocks themselves, but rather to color the water in the toilet bowl.

Many dyes suitable for use in the present invention are commercially available. Preferably the dye is water soluble. Still more preferably the dye is an acid dye and in particular an anionic acid dye. Exemplary dyes include Alizarine Light Blue B (C.I. 63010), Carta Blue VP (C.I. 24401), Acid Green 2G (C.I. 42085), Astragon Green D (C.I. 42040) Supranol Cyanine 7B (C.I. 42675), Maxilon Blue 3RL (C.I. Basic Blue 80), acid yellow 23, acid violet 17, a direct violet dye (Direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. Preferably the dye is a blue dye. A preferred dye for use in the blocks of the invention is Acid Blue 9.

The weight ratio of carboxymethylcellulose to dye is 1.5:1 to 0.8:2, preferably 1.3:1 to 0.9:2 and still more preferably about 1.1:1 to 1:2. When the dye is a blue dye, e.g. Acid Blue 9, the weight ratio of carboxymethylcellulose to dye is preferably 1.5:1 to 0.8:1, yet more preferably 1.3:1 to 0.9:1 and especially preferably about 1.1:1 to 1:1.

When the dye is a pink dye, however, the weight ratio of carboxymethylcellulose to dye is preferably 2:0.7 to 0.75:0.7, still more preferably 1.5:0.7 to 0.8:0.7, yet more preferably 1.3:0.7 to 0.9:0.7 and especially preferably about 1.1:0.7 to 1:0.7.

At these ratios, and particularly a weight ratio of 1.5:1 to 0.8:2 carboxymethylcellulose to dye, it is believed that the release rate of dye is optimized and that very little, if any, dye remains in the residue at the end of the toilet life of the block. Blocks comprising this ratio of carboxymethylcellulose and dye are therefore advantageous since the end of toilet life indication, namely the absence of color, more accurately reflects the actual end of toilet life. Furthermore, residue levels present at the end of the toilet life of the blocks are lowered as a result of the carboxymethylcellulose to dye ratio.

Thus, the replacement of guar gum with carboxymethylcellulose in the blocks of the present invention as well as the recited carboxymethylcellulose to dye ratio are both factors that work to reduce residue levels present at the end of the toilet life of the blocks of the present invention.

Preferred blocks of the present invention leave less than 3 wt % residue, based on the total weight of the block, at the end of its toilet life. More preferably the blocks of the present invention leave 0 to 2.5 wt %, more preferably 0 to 2 wt % and still more preferably 0 to 1 wt % reside, based on the total weight of the block at the end of its toilet life, e.g. as determined visually by the absence of color upon flushing. This is believed to be due to the presence of carboxymethylcellulose in the blocks which improve the release of its constituents, and in particular the dye, enabling a more complete release to occur. A more complete release of dye also occurs as a result of the ratio of carboxymethylcellulose to dye of 1.5:1 to 0.8:2 in the blocks of the present invention. These factors are highly advantageous since it means that less chemicals may be used to achieve a comparable perceived performance over a given period of time, i.e. less chemicals are wasted in residue.

The blocks of the present invention comprising carboxymethylcellulose and dye, particularly a blue dye, surprisingly produce a solution having a brighter blue color upon flushing with water than comparative blocks comprising guar gum. This is advantageous for a number of reasons. Aside from being considered more attractive or fashionable, it means, for example, that for a given concentration of dye in the flush water the user "sees" a brighter blue color and more strongly believes the block is working effectively, i.e. the perceived effect is greater. It also means that at lower concentrations of dye in the flush water, which typically occur towards the end of the toilet life of the block, the blue color can still be detected. This means that users are not prematurely informed to put a new block into the lavatory appliance.

Preferred blocks of the present invention are those which, in use in a lavatory appliance, produce a solution having a L* value of greater than 28.5, more preferably greater than 30.5 and still more preferably greater than 31 on the CIELAB Color Space Index, when determined spectrophotometrically using a Minolta CM3600-d spectrophotometer, e.g. as described in the examples. The upper limit for L* may, for example, be 50. Further preferred blocks of the present invention are those which, in use in a lavatory appliance, produce a solution having an a* value of less than −9.0, more preferably less than −10.0 and still more preferably less than −10.5 on the CIELAB Color Space Index, when determined spectrophotometrically using a Minolta CM3600-d spectrophotometer, e.g. as described in the examples. The lower limit for a* may, for example, be −20. Further preferred blocks of the present invention are those which, in use in a lavatory appliance, produce a solution having a b* value of less than −4.5, more preferably less than −5.5 and still more preferably less than −6.5 on the CIELAB Color Space Index, when determined spectrophotometrically using a Minolta CM3600-d spectrophotometer, e.g. as described in the examples. The lower limit for b* may, for example, be −15.

The blocks of the present invention comprise an alkane sulphonate, preferably a secondary alkane sulphonate and/or an alkyl aryl sulphonate. As used herein the term secondary alkane sulphonate is used to refer to dialkyl sulphonates. Alkane sulfonates also cause foaming and thus are additionally responsible for producing foam in the toilet bowl which is an effect that users of the blocks of the present invention perceive as a sign of activity.

Typically alkane sulphonates, e.g. secondary alkane sulphonates and alkyl aryl sulphonates, are provided in the form of their sodium salts. Examples of alkyl aryl sulphonates that may be present in the compositions of the present invention are those having an alkyl group that contains 6 to 24 carbon atoms and an aryl group selected from benzene, toluene, and xylene. An example of a suitable alkyl aryl sulphonate is sodium alkyl benzene sulphonate such as sodium dodecyl benzyl sulphonate. Other exemplary alkyl aryl sulphonates include xylene sulphonate and cumene sulphonate. Examples of dialkyl sulphonates that may be present in the compositions of the present invention are $C_{6-24}$ dialkyl sulphonates. A representative example is sodium $C_{14-17}$ sec-alkyl sulphonate.

Preferably the alkane sulphonate, e.g. secondary alkane sulphonate and/or alkyl aryl sulphonate, is present in an amount of 15 to 35%, more preferably 26 to 32% and still more preferably 27 to 30% by weight of the total block. The amount of alkane sulphonate present in the block has been found to influence the hardness of the block and its susceptibility to disintegration. Ideally the blocks of the present invention retain their shape for as long as possible during their toilet life and do not disintegrate readily. Once disintegration has occurred, the constituents of the block are rapidly flushed though and out of the toilet. An appropriate balance for the amount of alkane sulphonate is therefore important to the performance of the block including its toilet life.

The carboxymethylcellulose present in the blocks of the present invention is also believed to improve the release of the alkane sulphonate. Thus, as with dye, the carboxymethylcellulose is believed to have a lower tendency than guar gum to form an insoluble matrix that traps surfactants such as alkane sulphonate. As a result, a lower amount of alkane sulphonate can be incorporated into the blocks of the invention without comprising the amount of cleansing action and/or foaming that occurs upon flushing compared to blocks comprising guar gum. Preferably the weight ratio of alkane sulfonate to carboxymethylcellulose is 3:1 to 8:1, more preferably 4:1 to 6:1 and still more preferably 4.5:1 to 5.5:1.

The blocks of the present invention also comprise a hydrophobe which acts a solubility control agent to retard the dissolution of the block. Preferably the hydrophobe is selected from a terpene or a derivative thereof, $C_{9-11}$ primary alcohols or blends thereof, non-ionic surfactants, perfumes and mixtures thereof. Preferably the hydrophobe is a terpene and still more preferably the hydrophobe is pine oil. In some blocks the hydrophobe is preferably a mixture of pine oil and $C_{9-11}$ primary alcohols. In preferred blocks of the present invention the hydrophobe is present in an amount of 2 to 15% and more preferably 5 to 10% by weight of the total block.

Particularly preferred blocks of the present invention therefore comprise:

15 to 35 wt % alkane sulfonate;
2 to 15 wt % carboxymethylcellulose;
0.5 to 10 wt % dye; and
2 to 15 wt % hydrophobe,
wherein wt % is based on the total weight of the block.

Preferred blocks of the present invention further comprise one or more additional surfactants and preferably one or more additional anionic surfactants. Still more preferably the one or more additional anionic surfactants is a foam boosting surfactant. Yet more preferably the one or more additional anionic surfactants comprises an alpha-olefin sulphonate. Typically these are provided in the form of their sodium salts. Preferred α-olefin sulphonates are $C_{6-24}$ alkene sulphonates, particularly $C_{12-18}$ α-olefin sulphonates, especially $C_{14-16}$ olefin sulphonates. Particularly preferably the α-olefin sulphonate is a $C_{14-16}$ alkene sulfonate.

In preferred blocks of the present invention the one or more additional surfactants, e.g. the α-olefin sulphonate, is present in an amount of 2 to 10% and more preferably 2.5 to 9% and still more preferably 3.0 to 7.5% by weight of the total block. As with the alkane sulphonate, the release of alpha-olefin sulphonate provides cleansing activity and leads to the generation of foam in the toilet bowl during flushing which indicates to the user that the block is working.

Preferred blocks of the invention further comprise one or more density control agents. Density control agents are included to provide additional bulk to the blocks of the present invention and may enhance leaching of the active agent when the block is placed in water, rather than disintegration of the block. Preferably the density control agent ensures that the block exhibits a density greater than that of water which ensures that they will sink when suspended in a body of water, e.g., the water present within a cistern. Preferably the blocks exhibit a density in excess of about 1 g/cc of water, preferably a density in excess of about 1.4 g/cc of water and most preferably a density of at least about 1.6 g/cc of water. Preferred density control agents are soluble inorganic alkali, alkaline earth metal salt or hydrates thereof. Representative examples of density control agents include chlorides such as sodium chloride and magnesium chloride, carbonates and bicarbonates such as sodium carbonate and sodium bicarbonate, sulfates such as magnesium sulfate, copper sulfate, sodium sulfate and zinc sulfate and borax and borates such as sodium borate. Preferably, however, the density control agent comprises a sodium salt and particularly a sodium salt selected from sodium sulfate, sodium bicarbonate and sodium chloride. Especially preferably the sodium salt is sodium sulfate.

In preferred blocks of the present invention the density control agent is present in an amount of 0.1 to 45%, more preferably 10 to 40% and still more preferably 20 to 40% by weight of the total block.

Preferred blocks of the present invention further comprise at least one filler. Fillers generally modulate consumption of the block, i.e. prolong toilet life, and provide the block with a desirable texture. Any conventional filler may be used. The filler, when present, may be selected from an inorganic filler, such as for example silica, salts of alkali and/or alkaline-earth metals, clays and/or zeolites. Preferably the filler is a salt of an alkali and/or alkaline-earth metal. Representative examples of suitable fillers include magnesium sulfate, sodium sulfate or sodium carbonate. Magnesium sulfate is a preferred filler.

In preferred blocks of the present invention the filler is present in an amount of 0.1 to 10%, more preferably 2.5 to 7.5% and still more preferably 4 to 6% by weight of the total block.

Preferred blocks of the present invention further comprise a preservative. The preservative may also function as a disinfectant. Any conventional preservative may be used. Preservatives are primarily included to reduce the growth of undesired microorganisms within the blocks of the present invention during storage prior to use or while used. Exemplary useful preservatives include parabens, including methyl parabens and ethyl parabens, glutaraldehyde, formaldehyde, 2-bromo-2-nitropropane-1,3-diol, 5-chloro-2-methyl-4-isothiazolin-3-one, 2-methyl-4-isothiazoline-3-one, sodium orthophenylphenate, and mixtures thereof. A particularly preferred preservative is sodium orthophenylphenate. In preferred blocks of the present invention the preservative is present in an amount of 0.1 to 0.5%, more preferably 0.15 to 0.3% and still more preferably about 0.2% by weight of the total block.

Blocks of the present invention optionally comprise further ingredients which are conventional in the art. These include, for example, processing aids, water softening agents, bleaches, whiteners, perfumes, germicides, stain inhibitors, binders and so on. Preferably, however, the blocks of the present invention are substantially free of phosphorous, organic or inorganic phosphonates, organic or inorganic phosphates, and salts or derivatives thereof. Preferably, the blocks of the present invention are substantially free of peroxide-based oxidizing agents.

A preferred block of the present invention comprises:

15 to 35 wt % sodium alkylbenzenesulphonate;
3.5 to 9 wt % carboxymethylcellulose;
1.0 to 8.0 wt % Acid Blue 9;
4.5 to 10.0 wt % pine oil;
3.2 to 9.0 wt % sodium alpha-olefin sulphonate;
0 to 7.0 wt % magnesium sulfate.$3H_2O$;
0 to 45 wt % sodium sulfate;
0 to 4 wt % C9-C11 alcohol or alcohol blend; and
0 to 0.5 wt % sodium orthophenylphenate,
wherein wt % is based on the total weight of the block.

A particularly preferred block of the present invention comprises (e.g. consists of):

28 wt % sodium alkylbenzenesulphonate;
5.6 wt % carboxymethylcellulose;
5.0 wt % Acid Blue 9;
7.0 wt % pine oil;
4.8 wt % sodium alpha-olefin sulphonate;
5.5 wt % magnesium sulfate.$3H_2O$;
39.3 wt % sodium sulfate;

1.7 wt % sodium citrate;
0.02 wt % sodium bicarbonate;
2.0 wt % C9-C11 alcohol or alcohol blend;
0.2 wt % sodium orthophenylphenate; and
0.88 wt % water, wherein wt % is based on the total weight of the block.

Preferred blocks of the present invention have a total weight of 36 to 100 g, more preferably 45 to 90 g, still more preferably 50 to 80 g and yet more preferably 60 to 75 g. Preferred blocks of the present invention have a total surface area of 50 to 103 $cm^2$, more preferably 63 to 98 $cm^2$, still more preferably 65 to 94 $cm^2$ and yet more preferably 70 to 92 $cm^2$. In preferred uses of the blocks of the present invention, however, one face of the block lies against the lavatory appliance. Thus further preferred blocks of the present invention have a total effective surface area (i.e. surface area exposed to water in use) of 36 to 68 $cm^2$, more preferably 43 to 66 $cm^2$, still more preferably 45 to 64 $cm^2$ and yet more preferably 51 to 62 $cm^2$.

The blocks of the present invention may be formed into any 3D shape. Preferably, however, the blocks of the invention have a circular, square or rectangular cross section and in particular a circular cross section. The largest dimension of the cross section is preferably 4.0 to 10.0 cm, more preferably 7.0 to 9.5 cm and still more preferably 8.0 to 9.0 cm. When the cross section is circular, it preferably has a diameter of 4.25 to 7.0 cm, more preferably 5.0 to 6.5 cm and still more preferably 5.0 to 6.2 cm. The height or depth of the blocks of the invention (e.g. the distance between parallel cross sections) is preferably 1.0 to 3.0 cm, more preferably 1.5 to 2.5 cm and still more preferably 1.5 to 2.0 cm.

The blocks of the present invention may optionally be partially or fully enveloped by a water-soluble layer and/or coating. Such layers and/or coatings may be advantageous to improve the handling of the blocks, e.g. coatings can sometimes help to prevent blocks sticking to one another following manufacture and/or during packaging. In many blocks of the present invention, however, a water-soluble coating is not required.

The present invention also relates to a packaged product comprising at least one block as hereinbefore described. Preferred packaged products comprise a plurality of the blocks, e.g. 4, 5, 6, 7 or 8 blocks. Any conventional packaging may be used.

The blocks of the present invention may be used with or without an ancillary device or structure, such as a holder or cage. Preferred blocks of the present invention are in-cistern blocks. In a preferred use of the blocks of the present invention, the blocks are supplied to the cistern of a toilet where they sink and typically rest upon the bottom until they are consumed. In another use one or more blocks are supplied to the interior of a lavatory appliance, e.g., a toilet bowl or interior of a urinal wherein the block(s) is within the path of flush water flushed through the sanitary appliance during its normal manner of use.

The manufacture of the blocks of the present invention is well within the capability of persons of ordinary skill in the art. The blocks may, for instance, be manufactured by preparing a mixture of an alkane sulfonate, a carboxymethylcellulose, a dye, and a hydrophobe; extruding the mixture into rod or bar form; and cutting the rod or bar into blocks. Typically all of the solid ingredients of the block are mixed in any suitable blending equipment followed by the addition of liquid ingredients under blending conditions. The resulting homogeneous blend is then extruded.

The composition for forming the blocks of the present invention is also an aspect of the invention. Thus, in a further aspect the present invention relates to a composition comprising:

15 to 35 wt % alkane sulfonate;
2 to 15 wt % carboxymethylcellulose;
0.5 to 10 wt % dye; and
2 to 15 wt % hydrophobe;

wherein the weight ratio of carboxymethylcellulose to dye in said composition is 1.5:1 to 0.8:2 and wherein said composition is substantially free of guar gum.

Preferred compositions are the same as those set out above in relation to the block.

The use of a composition comprising an alkane sulfonate, a carboxymethylcellulose, a dye, and a hydrophobe in the preparation of a lavatory cleansing block as hereinbefore described forms a further aspect of the invention. Preferably the composition is substantially free of guar gum, and still more preferably does not comprise guar gum.

The toilet life of the blocks of the present invention is preferably at least 18 days, more preferably at least 30 days and still more preferably at least 56 days. Preferably the toilet life is 56 to 70 days, more preferably 60 to 65 days and still more preferably about 60 days. Preferably the perceived toilet life of the blocks of the present invention is the same as the actual toilet life of the blocks of the present invention. Thus preferably the perceived toilet life of the blocks of the present invention is also least 56 days. Preferably the perceived toilet life is 56 to 70 days, more preferably 60 to 65 days and still more preferably about 60 days. This means that the dye is completely released and more accurately reflects the end of the toilet life of the block.

The blocks of the present invention are effective in cleaning surfaces of lavatory appliances, particularly toilet cisterns, toilet bowls, urinals, and bidets. Thus the present invention also relates to a method of cleansing a lavatory appliance comprising: placing a lavatory cleansing block as hereinbefore described within a lavatory appliance. Preferably the block is placed in the cistern or under the rim of the toilet bowl and most preferably in the cistern. The invention also relates to the use of a lavatory cleansing block as hereinbefore described for cleansing a lavatory, wherein the block is placed in the lavatory, e.g. in the cistern or under the rim.

EXAMPLES

Materials

All starting materials employed are commercially available.

Carboxymethyl cellulose (CMC) was obtained from Ashland (trade name Blanose 9H4F/Blanose 9H4) or Crestchem (trade name Suncell PG-11). A 1% solution of the grade of CMC used has a viscosity range of 2500-4500 cP when tested at 25° C., 30 rpm with a rheometer and using an LV spindle. The CMC from Ashland had a 0.8-0.95 degree of substitution. The CMC from Crestchem had a 0.65-0.85 degree of substitution.

Sodium dodecylbenzenesulphonate (80% active with 4.8 wt % sodium citrate, 13.2 wt % sodium sulfate and 2 wt % water) was obtained from Unger Fabrikker A.S.

Magnesium sulfate.$3H_2O$ was obtained from Intermag Ltd.

Acid Blue 9 was obtained from Brenntag Ltd.

Pine oil was obtained from Chemox Pound Ltd.

Sodium orthophenylphenate was obtained from Lanxess Ltd.

Sodium alpha-olefin sulphonate (80% active with 16.7 wt % sodium sulfate, 0.3 wt % sodium bicarbonate and 3 wt % water) was obtained from Huntsman UK Ltd.

Sodium sulfate was obtained from Brenntag Ltd.

C9-C11 alcohol blend was obtained from Shell Chemicals.

Guar gum was obtained from Stanchem Ltd.

Analysis Methods

Spectrophotometric analysis was performed using a Minolta CM3600-d spectrophotometer. The sample solution was analyzed in a 10 mm focal length glass cell held in the transmission chamber of the Minolta CM3600-d spectrophotometer, using the full 30 mm aperture with no target mask. Samples were tested at 18° C. and over a wavelength range of 400-700 nm.

The concentration of solutions tested were 0.01 wt % and 0.0063 wt % in aqueous solution (deionised water) for Blocks 1 and 2 respectively. The difference in concentration was to achieve a 1:1 mass ratio of dye in both samples.

Preparative Example 1: Preparation of a CMC-Containing Block

A block was produced from the following composition (Block 1):

| Component | Actual % w/w |
|---|---|
| Sodium dodecylbenzenesulphonate | 28.0 |
| Magnesium sulfate•$3H_2O$ | 5.5 |
| Acid Blue 9 | 5.0 |
| Pine Oil | 7.0 |
| Sodium orthophenylphenate | 0.2 |
| Carboxymethyl cellulose (CMC) | 5.6 |
| Sodium alpha-olefin sulphonate | 4.8 |
| C9-C11 alcohol blend | 2.0 |
| Sodium sulfate | 39.3 |
| Sodium citrate | 1.7 |
| Sodium bicarbonate | 0.02 |
| Water | 0.88 |

The composition was extruded under standard conditions in a Sunlab P75 extruder, with a 50 mm diameter plate. The cylindrical body was then cut into lengths and pressed in a 62 mm mold using a hand press (Research & Industrial Instruments Company) to form blocks having a mass of 70 g each. The total surface area of each block was about 93 $cm^2$.

Preparative Example 2: Preparation of a Guar Gum-Containing Block

A comparative block was produced from the following composition (Comparative Block 2):

| Component | Actual % w/w |
|---|---|
| Sodium dodecylbenzenesulphonate | 28.0 |
| Magnesium sulfate•$3H_2O$ | 7.0 |
| Acid Blue 9 | 7.9 |
| Pine oil | 7.0 |
| Sodium orthophenylphenate | 0.2 |
| Guar gum | 9.0 |
| Sodium sulfate | 38.5 |
| Sodium citrate | 1.7 |
| Water | 0.7 |

The composition was extruded under standard conditions in a Sunlab P75 extruder, with a 50 mm diameter plate. The cylindrical body was then cut into lengths and pressed in a 62 mm mold using a hand press (Research & Industrial Instruments Company) to form blocks having a mass of 70 g each. The total surface area of each block was about 93 $cm^2$.

The main differences between Blocks 1 and 2 is that Block 1 comprises carboxymethylcellulose whereas Block 2 comprises guar gum. The weight ratio of carboxymethylcellulose or guar gum to dye is the same in both blocks (1.1:1).

Example 1: Evaluation of the Toilet Life of Blocks in Hard and Soft Water

A single block (either Block 1 or Block 2, prepared as described above) was placed in the cistern of a wash-down UK 9-liter Magnia Armitage Shanks toilet and the toilet was flushed 12 times a day according to an automated flush protocol using a supply of either hard or soft water. The water was maintained at an ambient temperature of 16-19° C.

FIG. 1 is a diagram describing the automatic flush protocol employed to test the two different blocks. Each 'X' indicates the exact time at which the toilet was flushed each day. The first flush was programmed for 10:10 am every day. The flush protocol shown in FIG. 1 was designed to mimic typical household toilet use and therefore incorporates high frequency flush periods and extended dwell times between flushing.

Hard Water

The CMC-containing block functioned efficiently for over 65 days. FIG. 2*a* shows the residue remaining in the cistern at day 66 of the test, which was analyzed visually and using photo editing software. The guar gum-containing block functioned efficiently for over 75 days. FIG. 2*b* shows the residue remaining in the cistern at day 78 of the test, which was analyzed visually and using photo editing software. It is clear to see that, at the end of the life of the two blocks, the amount of residue remaining in the cistern is considerably less for the CMC-containing block than for the guar gum-containing block. This was also confirmed in the semi-quantitative analysis carried out using photo editing software wherein it was estimated that Block 1 covers 40% of the cistern floor to the left of the ball float with a light residue and Block 2 covers 87% of the cistern floor to the left of the ball float with a heavy residue (nb—the residue was categorized as heavy or light based on the residue color). Without wishing to be bound by theory, this is believed to be due to the better release properties of carboxymethylcellulose compared to guar gum. The guar gum tends to form an insoluble matrix which traps other constituents of the block and prevents their release. This does not occur with carboxymethylcellulose which dissolves and/or disintegrates more completely.

FIG. 3 shows the appearance of the toilet bowl comprising Block 1 immediately after flushing on day 66 of the test, which was also analyzed visually. The foam is poor and the blue color of the bowl water has diminished, confirming that the block had reached the end of its toilet life.

Figure 4:
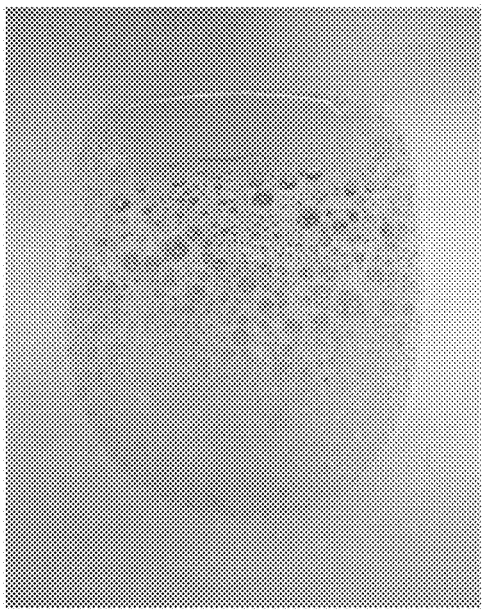
FIG. 4 is a photograph showing the end of life performance in the toilet bowl of a guar gum-containing block when tested using a supply of hard water.

FIG. 4 shows the appearance of the toilet bowl comprising Block 2 immediately after flushing on day 78 of the test, which was also analyzed visually. The foam is poor and the bowl water lacks color, confirming that the block had reached the end of its toilet life.

It is clear that the Blocks 1 and 2 had reached the end of their toilet lives by days 66 and 78 respectively. At the end of toilet life, there is considerably more residue, and particularly blue residue, remaining in the cistern containing Block 2 than Block 1. This can be perceived as a negative by the user, and often requires considerable agitation and repeat flushing to remove all traces of the residue.

Soft Water

Figure 5A:
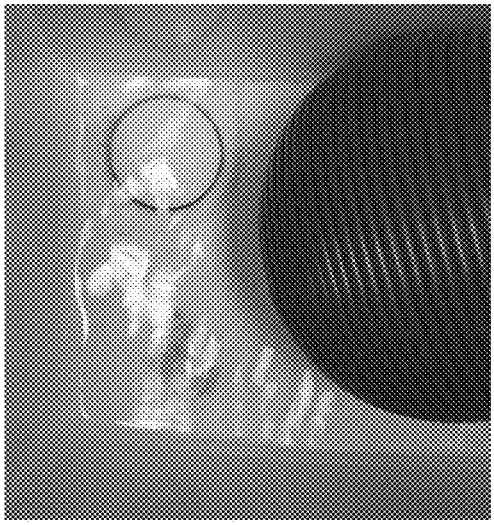
FIG. 5*a* is a photograph showing the residue remaining in the cistern at the end of the toilet life of a CMC-containing block when tested using a supply of soft water.
Figure 5B:
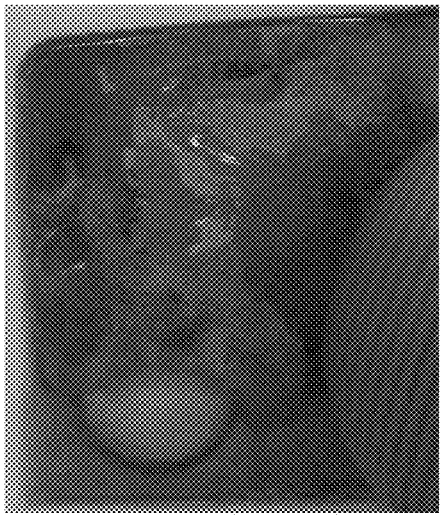
FIG. 5*b* is a photograph showing the residue remaining in the cistern at the end of the toilet life of a guar gum-containing block when tested using a supply of soft water.

The CMC-containing block functioned efficiently for over 56 days. FIG. 5*a* shows the residue remaining in the cistern at day 56 of the test, which was analyzed visually. The guar gum-containing block functioned efficiently for over 75 days. FIG. 5*b* shows the residue remaining in the cistern at day 70 of the test, which was analyzed visually. It can clearly be seen that, at the end of the life of the blocks, the amount of residue remaining in the cistern is considerably less for the CMC-containing block than for the guar gum-containing block. This was also confirmed in the semi-quantitative analysis carried out using photo editing software wherein it was estimated that Block 1 covers 2% of the cistern floor to the left of the ball float with a light residue and Block 2 covers 100% of the cistern floor to the left of the ball float with a heavy residue (nb—the residue was categorized as heavy or light based on the residue color). This correlates with the results obtained with hard water.

Example 2: Evaluation of Toilet Bowl Water Color Brightening Effect

In order to simulate and test the water color of the water in a toilet bowl treated with the blocks of the present invention, an aqueous solution of three CMC-containing blocks was prepared in the laboratory as discussed below. A comparative solution of the guar gum-containing block 2 described above was also prepared. The composition of the CMC-containing blocks was as shown in the table below. Blocks 3 and 4 were prepared by the same method as described above for Block 1.

| Component | Block 1 % w/w | Block 3 % w/w | Block 4 % w/w |
|---|---|---|---|
| Sodium dodecylbenzenesulphonate (80%) | 28.0 | 24.0 | 24.0 |
| Magnesium sulfate•$3H_2O$ | 5.5 | 5.5 | 5.5 |
| Acid Blue 9 | 5.0 | 5.0 | 5.0 |
| Pine Oil | 7.0 | 6.0 | 6.0 |
| Sodium orthophenylphenate | 0.2 | 0.2 | 0.2 |
| Carboxymethyl cellulose (CMC) | 5.6 Blanose 9H4F | 5.5 Blanose 9H4 | 5.5 Crestchem (Suncell PG-11) |
| Sodium alpha-olefin sulphonate (80%) | 4.8 | 3.2 | 3.2 |
| C9-C11 alcohol blend | 2.0 | 1.5 | 1.5 |
| Sodium sulfate | 39.3 | 46.97 | 46.97 |
| Sodium citrate | 1.7 | 1.4 | 1.4 |
| Sodium bicarbonate | 0.02 | 0.01 | 0.01 |
| Water | 0.88 | 0.72 | 0.72 |

Fresh aqueous solutions (0.01% w/v) of equal masses of blue dye (Acid Blue 9 CI42090) were prepared by dissolving each of the above-described blocks in water at 20° C. Comparative Block 2 contains 7.9% w/w of blue dye whereas each of the CMC-containing blocks contain 5% w/w blue dye. The solution strength of Block 2 was therefore adjusted to match the mass of dye present in the other Blocks.

Figure 6:
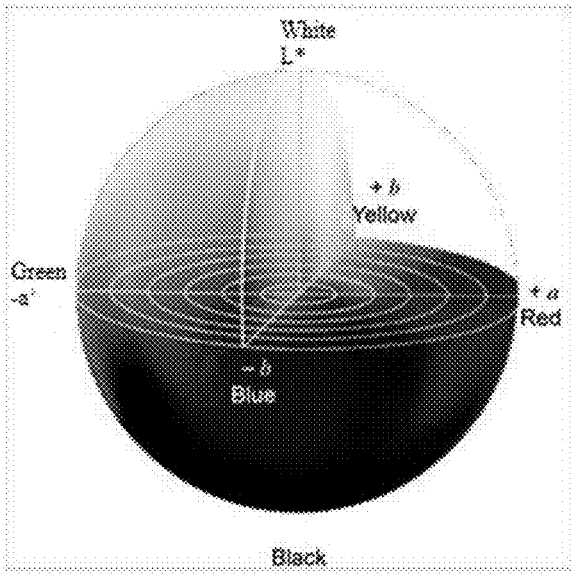
FIG. 6 is a CIELAB color space map which can be used to explain the differences between the aqueous solutions produced by blocks of the invention compared to guar gum-containing blocks.

A Minolta CM3600-d spectrophotometer was used to determine the CIELAB Color Space Index for each solution. The CIELAB color space map is shown in FIG. 6. This shows the following:

+L=white
−L=black
+a=red
−a=green
+b=yellow
−b=blue.

Figure 7:
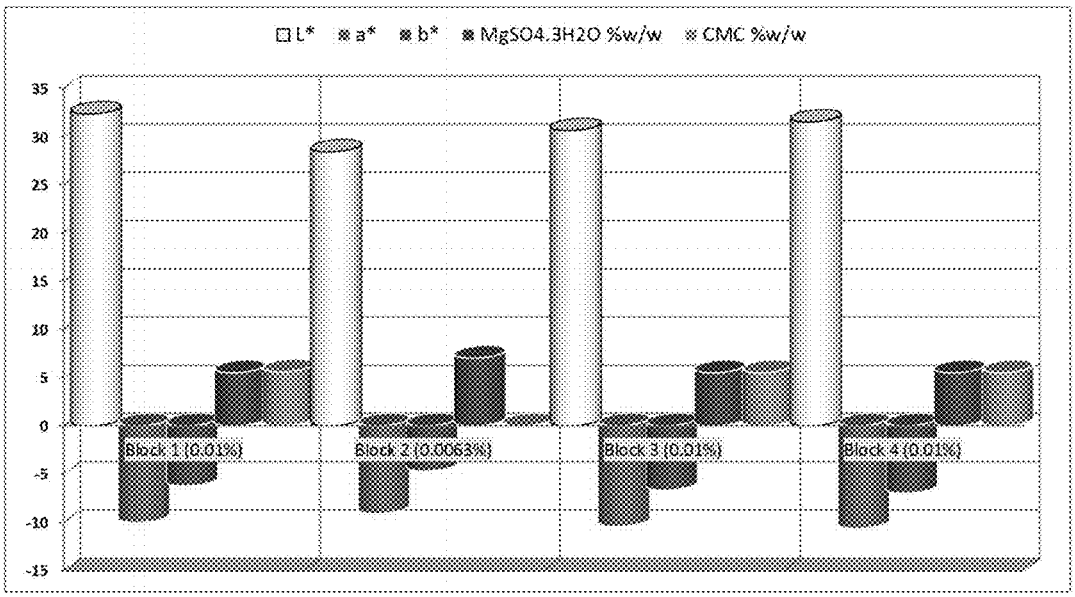
FIG. 7 is a bar chart showing the Color Space Index for aqueous solutions of blocks of the invention compared to guar gum-containing blocks.

The results for the toilet blocks tested are shown in FIG. 7 and in the table below.

| | Block 1 | Block 2 (comparative) | Block 3 | Block 4 |
|---|---|---|---|---|
| L* | 32.35 | 28.41 | 30.62 | 31.51 |
| a* | −10 | −9.06 | −10.41 | −10.6 |
| b* | −6.21 | −4.66 | −6.64 | −6.95 |

The results show that the L* value is higher for the three CMC-containing blocks compared to the guar-gum containing block. This positive difference in the L parameter for the CMC-containing solutions compared to the guar gum-containing solution suggests a shift towards white on the color map. Such a shift towards white indicates that the CMC-containing solutions display a brighter color than the guar gum-containing solution.

The results also show that the a* and b* parameters move further into the green and blue space of the color map meaning that the intensity of the blue color will be increased.

The combination of these two results is that an aqueous solution of a CMC-containing block containing Acid Blue 9 dye displays a brighter blue color than an aqueous solution of a guar gum-containing block containing the same amount of Acid Blue 9 dye. This indicates that when the CMC-containing blocks are used in a toilet cistern, they will deliver a superior color and brightening effect to the toilet bowl water than will the guar gum-containing blocks.

The peak absorption wavelength was also measured for each solution tested and it was identical (629 or 630 nm) for all of the blocks. This is consistent with what is expected for solutions of Acid Blue 9 and indicates that the Acid Blue 9 is not chemically altered by the presence of carboxymethylcellulose in the base. The increased brightness and blue color produced by the blocks of the invention therefore appears to be a result of a physical interaction between the dye and the polymer.

What is claimed is:

1. A lavatory cleansing block comprising:
an alkane sulfonate;
a carboxymethylcellulose;
a preservative;
a dye; and
a hydrophobe;
wherein the weight ratio of carboxymethylcellulose to dye in said block is 1.5:1 to 0.8:2 and wherein said block is free of guar gum; and
wherein the preservative is sodium orthophenylphenate.

2. The lavatory cleansing block as claimed in claim 1, wherein the weight ratio of carboxymethylcellulose to dye lowers the residue levels present at the end of the toilet life of said block.

3. The lavatory cleansing block as claimed in claim 1, wherein the amount of dye present in said block is 0.5 to 10% by weight of the block.

4. The lavatory cleansing block as claimed in claim 1, wherein said carboxymethylcellulose is present in an amount of 3 to 10% by weight of the block.

5. The lavatory cleansing block as claimed in claim 1, wherein said carboxymethylcellulose has a viscosity range of 1000 to 8000 cP when tested as a 1% solution in water at 25° C., 30 rpm and using a rheometer.

6. The lavatory cleansing block as claimed in claim 1, wherein said carboxymethylcellulose has a degree of substitution of 0.6-1.45.

7. The lavatory cleansing block as claimed in claim 1, which leaves less than 3 wt % residue, based on the total weight of the block, at the end of its toilet life.

8. The lavatory cleansing block as claimed in claim 1, which in use in a lavatory appliance, produces a solution having a L* value of greater than 28.5.

9. The lavatory cleansing block as claimed in claim 1, which when in use in a lavatory appliance, produces a solution having an a* value of −9.0 or less.

10. The lavatory cleansing block as claimed in claim 1, which when in use in a lavatory appliance, produces a solution having a b* value of −4.5 of less.

11. The lavatory cleansing block as claimed in claim 1, wherein said alkane sulfonate is sodium alkylbenzenesulfonate.

12. The lavatory cleansing block as claimed in claim 1, wherein said alkane sulfonate is present in an amount of 15 to 35% by weight of the total block.

13. The lavatory cleansing block as claimed in claim 1, wherein the weight ratio of alkane sulfonate to carboxymethylcellulose is 3:1 to 8:1.

14. The lavatory cleansing block as claimed in claim 1, wherein said hydrophobe is selected from a terpene or a derivative thereof, $C_{9-11}$ primary alcohols, non-ionic surfactants, perfume and mixtures thereof.

15. The lavatory cleansing block as claimed in claim 14, wherein said hydrophobe is pine oil or a mixture of pine oil and $C_{9-11}$ primary alcohols.

16. The lavatory cleansing block as claimed in claim 1, wherein said hydrophobe is present in an amount of 2 to 15% by weight of the total block.

17. The lavatory cleansing block as claimed claim 1 comprising:

15 to 35 wt % alkane sulfonate;
2 to 15 wt % carboxymethylcellulose;
0.5 to 10 wt % dye; and
2 to 15 wt % hydrophobe,
wherein wt % is based on the total weight of the block.

18. The lavatory cleansing block as claimed in claim 1, further comprising 2 to 10% alpha-olefin sulphonate, based on the total weight of the cleansing block.

19. The lavatory cleansing block as claimed in claim 1, further comprising 0.1 to 45 wt % sodium sulfate, based on the total weight of the cleansing block.

20. The lavatory cleansing block as claimed in claim 1, further comprising 0.1 to 10 wt % magnesium sulfate, based on the total weight of the cleansing block.

21. The lavatory cleansing block as claimed in claim 1, comprising:

15 to 35 wt % sodium alkylbenzenesulphonate;
3.5 to 9 wt % carboxymethylcellulose;
1.0 to 8.0 wt % Acid Blue 9;
4.5 to 10.0 wt % pine oil;
3.2 to 9.0 wt % sodium alpha-olefin sulphonate;
0 to 7.0 wt % magnesium sulfate.$3H_2O$;
0 to 45 wt % sodium sulfate;
0 to 4 wt % C9-C11 alcohol or alcohol blend; and
0.1 to 0.5 wt % sodium orthophenylphenate,
wherein wt % is based on the total weight of the block.

22. The lavatory cleansing block as claimed in claim 1, comprising:

28 wt % sodium alkylbenzenesulphonate;
4.6 wt % carboxymethylcellulose;
4.0 wt % Acid Blue 9;
6.0 wt % pine oil;
4.8 wt % sodium alpha-olefin sulphonate;
4.5 wt % magnesium sulfate.$3H_2O$;
39.3 wt % sodium sulfate;
1.7 wt % sodium citrate;
0.02 wt % sodium bicarbonate;
2.0 wt % C9-C11 alcohol or alcohol blend;
0.2 wt % sodium orthophenylphenate; and
0.88 wt % water,
wherein the wt % is based on the total weight of the block.

23. The lavatory cleansing block as claimed in claim 1, wherein said block has a circular cross section.

24. The lavatory cleansing block as claimed in claim 1, which is at least partially enveloped by a water soluble layer or coating.

25. The lavatory cleansing block as claimed in claim 1, which is an in-cistern block.

26. The lavatory cleansing block as claimed in claim 1, which has a toilet life of at least 60 days.

27. A method of cleansing a lavatory appliance, comprising: placing a lavatory cleansing block as claimed in claim 1 within a lavatory appliance.

28. A composition comprising:

15 to 35 wt % alkane sulfonate;
2 to 15 wt % carboxymethylcellulose;
0.1 to 0.5 wt % preservative;
0.5 to 10 wt % dye; and
2 to 15 wt % hydrophobe;
wherein the weight ratio of carboxymethylcellulose to dye in said composition is 1.5:1 to 0.8:2 and wherein said composition is free of guar gum; and
wherein the preservative is sodium orthophenylphenate.

* * * * *